US009058045B2

(12) United States Patent
Vanhecke

(10) Patent No.: US 9,058,045 B2
(45) Date of Patent: Jun. 16, 2015

(54) CURRENT GENERATOR, NOTABLY FOR CURRENT OF THE ORDER OF NANO-AMPERES, AND VOLTAGE REGULATOR USING SUCH A GENERATOR

(75) Inventor: Claude Vanhecke, Pechbonnieu (FR)

(73) Assignee: THALES, Courbevoie (FR)

( * ) Notice: Subject to any disclaimer, the term of this patent is extended or adjusted under 35 U.S.C. 154(b) by 874 days.

(21) Appl. No.: 13/236,480

(22) Filed: Sep. 19, 2011

(65) Prior Publication Data

US 2012/0068684 A1 Mar. 22, 2012

(30) Foreign Application Priority Data

Sep. 17, 2010 (FR) ..... 10 03707

(51) Int. Cl.
*G05F 1/613* (2006.01)
*G05F 3/24* (2006.01)
*G05F 1/575* (2006.01)

(52) U.S. Cl.
CPC ..... *G05F 3/242* (2013.01); *G05F 1/575* (2013.01)

(58) Field of Classification Search
USPC ..... 323/311–317; 327/108
See application file for complete search history.

(56) References Cited

U.S. PATENT DOCUMENTS 5,216,384 A * 6/1993 Vanhecke ..... 330/279
5,783,934 A 7/1998 Tran

FOREIGN PATENT DOCUMENTS

EP 2172828 A1 4/2010
JP 3131916 A 6/1991

OTHER PUBLICATIONS

Henri J. Oguey et al.: "CMOS Current Reference Without Resistance," IEEE Journal of Solid-State Circuits, IEEE Service Center, Piscataway, NJ, USA, vol. 32, No. 7, Jul. 1, 1997.
Matsuda T. et al.: "A Temperature and Supply Voltage Independent CMOS Voltage Reference Circuit," IEICE Transactions on Electronics, Institute of Electronics, Tokyo, JP, vol. E88-C, No. 5, May 1, 2005, pp. 1087-1093.
Preliminary Search Report for French Patent App. No. FR1003707 (Aug. 1, 2011).

* cited by examiner

*Primary Examiner* — Adolf Berhane
*Assistant Examiner* — Nusrat Quddus
(74) *Attorney, Agent, or Firm* — Baker & Hostetler LLP

(57) ABSTRACT

An ultra-low current generator and a voltage regulator using such a generator. The generator includes a first set of Q transistors connected as a current mirror and able to be linked to a supply voltage; a second set of Q-1 transistors connected as a current mirror and each connected in series to one of the transistors in the first set of transistors; a first transistor connected in series with a transistor in the second set of transistors; and a second transistor, connected as a current mirror with the first transistor, and connected in series with a transistor included in the first set of transistors. The first transistor operates in its linear zone, a value of a current generated by the current generator depends on an equivalent resistance of the first transistor, and the first and second transistors have ultra-long channels, with a very large length/width ratio.

9 Claims, 13 Drawing Sheets

A
A
74
81
N4
71
81
72
N3R
71
74
74
81
71
74
81
71
74
p-
p-tub
n-tub
p-tub
p-
N4
N3R
Section through AA
75

CURRENT GENERATOR, NOTABLY FOR CURRENT OF THE ORDER OF NANO-AMPERES, AND VOLTAGE REGULATOR USING SUCH A GENERATOR

CROSS-REFERENCE TO RELATED APPLICATIONS

This application claims priority to foreign French patent application No. FR 10 03707, filed on Sep. 17, 2010, the disclosure of which is herein incorporated by reference in its entirety.

FIELD OF THE INVENTION

The present invention relates to a current generator. The invention also relates to a voltage regulator using such a generator. It applies notably to the generation of ultra-low currents which are quasi-stable in terms of temperature and variation of the supply voltage, in integrated circuits. The invention also applies to the production of series-type stable voltage regulators with very low dropout voltage, whatever the electrical energy source at input.

BACKGROUND OF THE INVENTION

The weight of onboard hardware remains a major constraint for aircraft. The increasing complexity of electrical, electronic and computer systems gives rise to ever greater amounts of wiring inside airplanes. Thus, hundreds of kilometers of copper cables run through the interior of airplanes, which contributes to increasing the total weight of the onboard hardware. The use of conducting wires that are less dense, made of aluminum for example, does not suffice to solve the problem, given the lengths involved. An effective solution consists in eliminating the maximum of wiring cables and in using autonomous energy sources to power the various components. An exemplary application relates notably to the multitude of sensors located at various places in an airplane. A solution eliminating the wiring then consists in placing an autonomous energy source in proximity to each sensor or to a set of sensors.

In the avionics sector, it is not possible to use batteries because of their overly short lifetime and of their poor temperature performance. One solution consists in using an energy source which recovers the ambient energy for example thermal transducers. It is thus possible to use transducers using the "Seebeck" effect or reverse Pelletier effect. These transducers deliver an electrical potential difference utilizing the difference in temperature between a quantity of water stored inside the transducers and the ambient air, this temperature difference being brought about by the differences in thermal inertia between water and air, or any other temperature gradient. In the case of an airplane, the temperatures of the water and of the air evolve differently in the course of the flight on account of these thermal inertias. Other types of transducers may be used, notably mechanical transducers which may for example utilize the mechanical vibrations of an airplane. These transducers comprise beams of very small size having several branches, the vibrations transmitted to these beams bringing about electrical energy.

These transducers provide voltages or currents which are not stabilized over time. They therefore cannot power electronic components directly. It is known to use voltage or current regulators linked at input to an unstabilized power supply such as a transducer and providing as output a defined voltage, for example 3 volts. Because of the low energy level delivered by the aforementioned transducers, it is necessary to produce regulators which consume a very low energy level, therefore having a very low dropout voltage and very low bias currents, while taking account of the constraints of production, notably as integrated circuits.

An aim of the invention is therefore notably to allow the production of integrated electronic circuits consuming a minimum of current, typically in the nano-power sector, of the order of a few nano-watts.

SUMMARY OF THE INVENTION

For this purpose, the subject of the invention is a current generator using field-effect transistors, comprising:

- a first set of Q of transistors P1, P2, P3 connected as a current mirror and able to be linked to a supply voltage Vdd;
- a second set of Q−1 of transistors N1, N2 connected as a current mirror, whose channels have a polarity that is the reverse of that of the transistors of the first set, each transistor N1, N2 being connected in series to a transistor of the first set;
- a first transistor N1 of the second set being connected in series with a transistor N3R, having a channel of the same polarity, connected as a current mirror with a transistor N4, this transistor N4 being connected in series with a last transistor P3 of the first set;

the transistor N3R being able to operate in its linear zone, the value of the current generated being dependent on the equivalent resistance $R_{eq}$ of this transistor, the transistors N3R and N4 having an ultra-long channel, so that the ratio L/W is at least greater than several hundred, L being the length of the channel and W its width, the values of L, of W and of the ratio L/W being determined so as to obtain at one and the same time a value of current which is stable as a function of the variations of the supply voltage, but also to obtain a value of current which is quasi-stable as a function of temperature, and also to obtain a voltage VGS of these same transistors that is very stable as a function of temperature.

The ratio L/W may be at least greater than 500 and the width W may be of the order of 0.6 μm.

Advantageously, the generator is able to be used as voltage reference $V_{Ref}$, said reference being provided at the level of gates of the transistors N3R and N4.

The transistors P1, P2, P3 of the first set are for example of P-channel type.

Another subject of the invention is a voltage regulator, for regulating between an input voltage and an output voltage Vs, using field-effect transistors, the regulator comprising:

- a current generator such as previously described;
- a P-channel field-effect output transistor P5 linked at its source to the input voltage of said regulator and delivering on its drain the output voltage;
- an operational amplifier linked on its negative input to the reference voltage of said generator;
- a P-channel transistor P4, connected as a current mirror with the transistors of the first set of said generator;
- an N-channel transistor N5, connected as a current mirror with the transistors of the second set of said generator;
- a pair of transistors (N10, P10) connected between the transistor P4 and the transistor N5, the pair comprising a first transistor N10, of N-channel type, and a second transistor P10, of P-channel type, the gate and the drain of the first transistor N10 being together linked to the source of the second transistor P10 linked to the drain of the transistor P4 and to the drain of the output transistor P5 the source of the first transistor N10 and the drain of the second transistor P10 being together linked to the positive input of the operational amplifier and to the drain of the transistor N5, the channel of the first transistor N10 being very long, so that the ratio L/W is very large, L being the length of the channel and W its width; the voltage step $V_{ref}$ present across the terminals of the transistor N4 being reproduced across the terminals of the transistor N10 when the latter is switched to the on state, the output voltage being incremented according to a voltage step dependent on the control of the transistor N10.

Advantageously, the regulator comprises for example a number K of pairs of transistors N10,P10, N11,P11, N12,P12 connected in series between the transistor P4 and the transistor N5, K being greater than 1, each first transistor N10, N11, N12 of a pair exhibiting across these terminals said voltage step $V_{ref}$ when it is switched to the on state, the regulator comprising means of control of the pairs of transistors, the output voltage being dependent on a given number of voltage steps $V_{ref}$ according to the combination of the control states applied to the transistor pairs.

BRIEF DESCRIPTION OF THE DRAWINGS

Other characteristics and advantages of the invention will become apparent with the aid of the description which follows, offered in relation to appended drawings which represent.

MORE DETAILED DESCRIPTION

Figure 1:
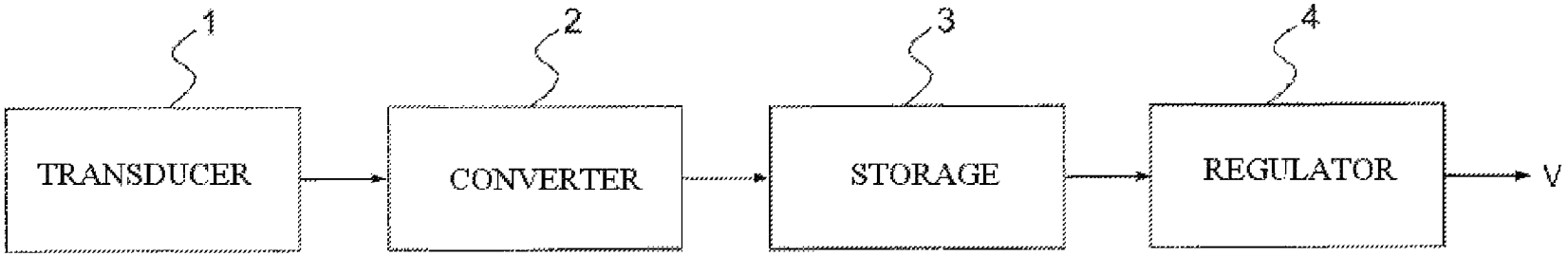
FIG. 1, a schematic presentation of an autonomous electrical power supply system.

FIG. 1 illustrates in a schematic manner an autonomous electrical power supply system based on an energy recovery device. It comprises at input a transducer 1 transforming a physical phenomenon, such as a temperature difference or vibrations into electrical energy. The transducer 1 is followed by a converter 2 transforming the electrical voltage delivered by the transducer into a DC voltage. Indeed the voltage output by the transducer may be continuous, alternating or more generally periodic. In all cases, it is transformed by the converter 2 into a DC voltage which is not yet that for use by the electronic components. The converter 2 is followed by a storage element 3 such as a capacitor of very high capacitance for example. Finally a regulator 4 delivers a reference voltage V in a given span of variation according to the level of precision desired.

Figure 2B:
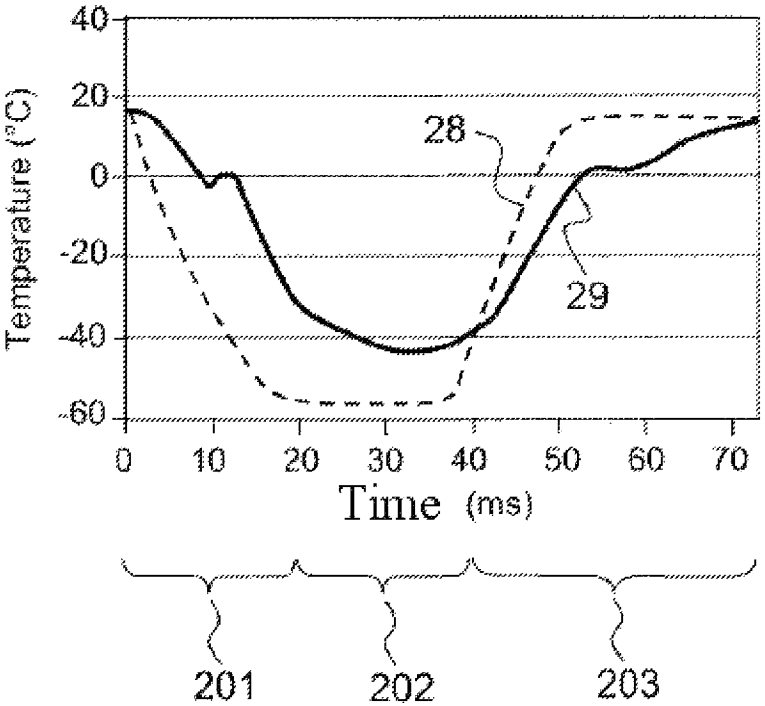
FIGS. 2*a* to 2*c*, a presentation of an exemplary thermal transducer and of its operation.
Figure 2A:
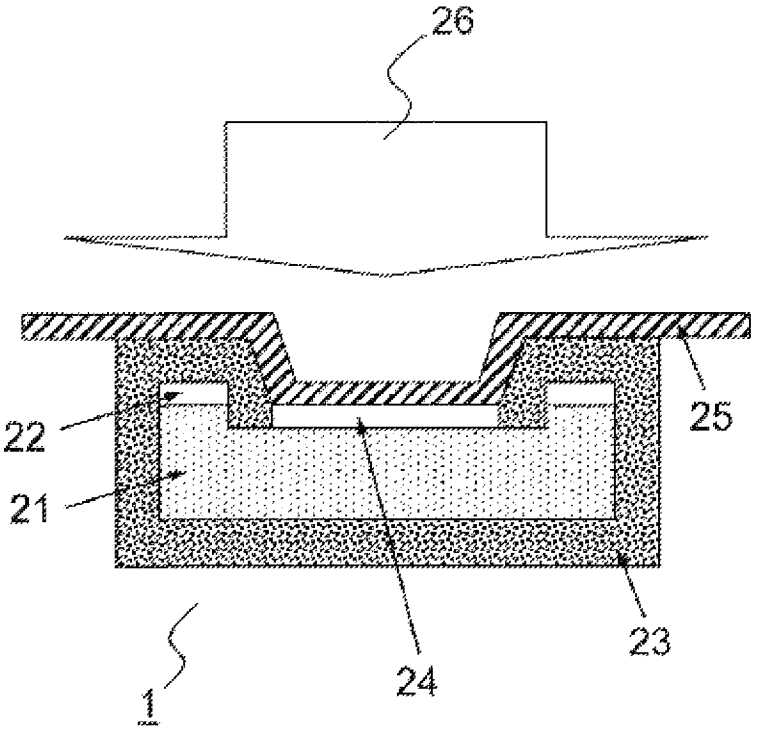
Figure 2C:
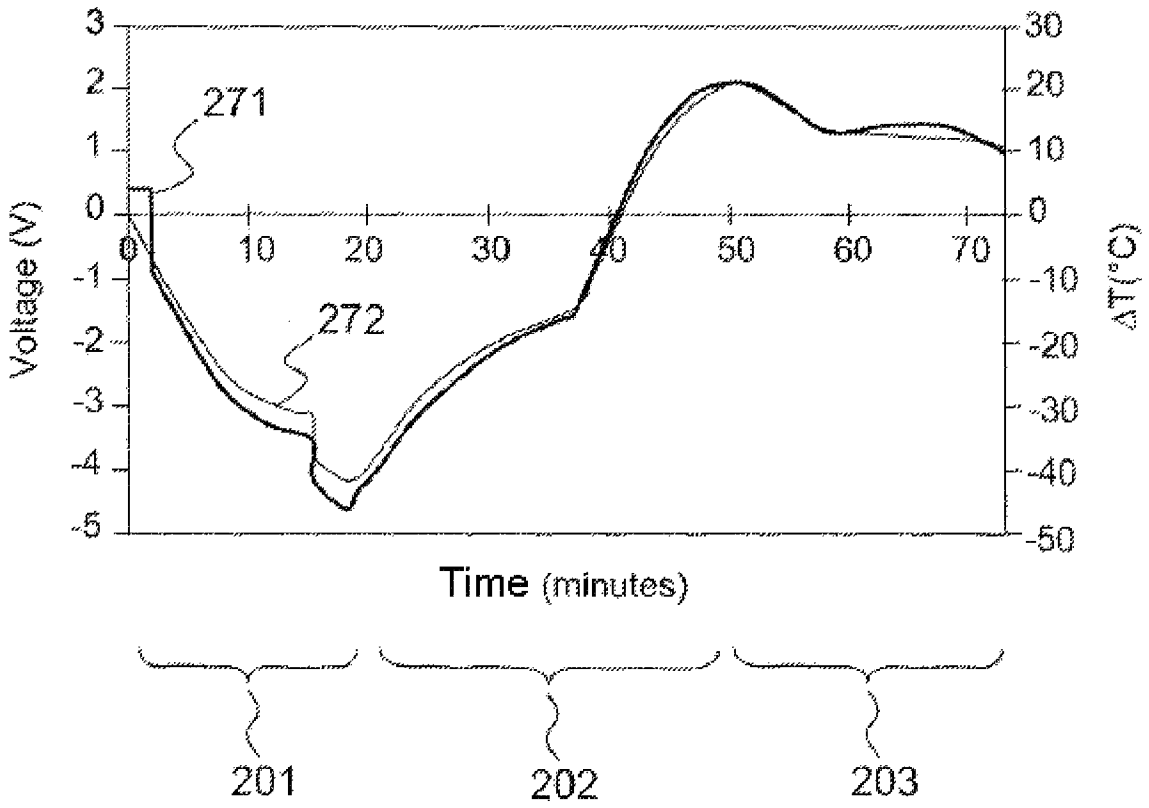

FIGS. 2*a*, 2*b* and 2*c* illustrate the operation of a thermal transducer using the Seebeck effect. More precisely FIG. 2*a* presents the constituent elements of such a transducer. It comprises a reserve of water 21 and of air 22 stored in a receptacle made of thermal insulant 23 closed by a thermogenerator 24 in contact with a metallic wall 25 swept by a stream of air 26, in the case for example where the transducer is mounted on an airplane. FIG. 2*b* illustrates by two curves 28, 29 the evolution of the temperatures of the air and of the water as a function of time. A first curve 28 illustrates the variation of the temperature of the air successively during the takeoff phase 201, during the cruising flight phase 202 and during the landing phase 203. A second curve 29 illustrates the evolution of the temperature of the water for the same phases. FIG. 2*c* illustrates by a first curve 271 and by a second curve 272 respectively the profile of the temperature discrepancy ΔT between the air and the water and the profile of the output voltage provided by the transducer as a function of time for the preceding phases 201, 202, 203. The voltage delivered 272 exhibits the profile of a sinusoid with a single alternation during the whole of the airplane's flight phase.

Figure 3:
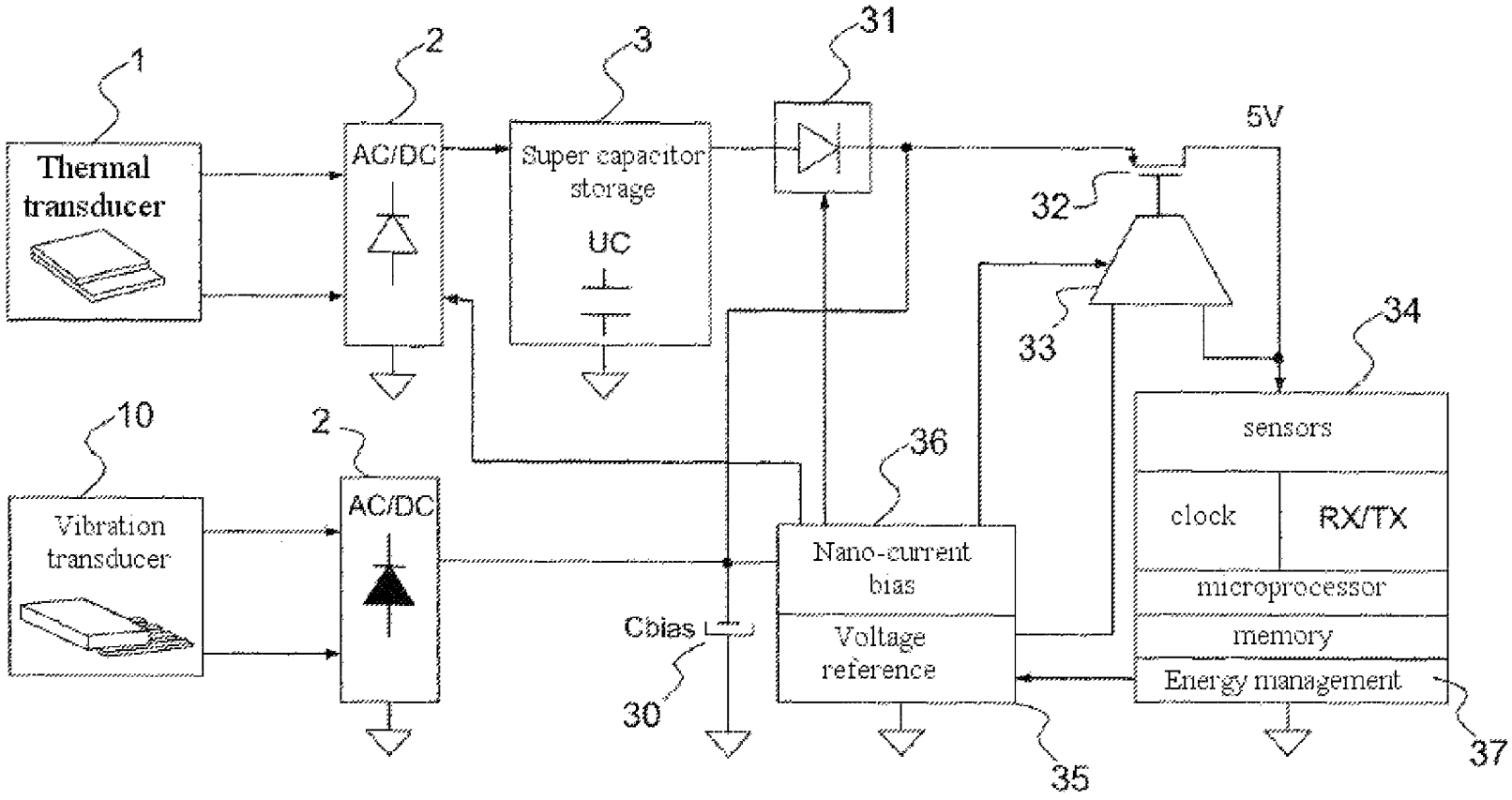
FIG. 3, a more detailed presentation of an autonomous power supply system with series regulation using at least one transducer as autonomous energy source.

FIG. 3 illustrates in greater detail an energy recovery chain of the type of FIG. 1 in a case where there are two autonomous sources of energy recovery. The system comprises a first transducer 1 which is a thermal transducer such as illustrated by FIGS. 2*a* to 2*c*. Such a transducer can provide electrical power included in a span whose lower bound is of the order of a microwatt (μW) and whose upper bound is of the order of several milliwatts (mW). The voltage delivered by the transducer 1 is rectified into a DC voltage by means of a converter 2 whose output is linked to an electrical energy storage element 3, for example a storage super capacitor.

The system moreover comprises a second transducer 10. This is a mechanical transducer utilizing mechanical vibrations. As indicated previously this type of transducer comprises beams transmitting the vibrations on the basis of which the electrical energy is produced. Such a transducer 10 can provide electrical power ranging from a few nanowatts (nW) to a few microwatts (μW). The electrical voltage delivered is converted into DC voltage by a converter 2. The output of this converter charges a capacitor 30 acting as energy store and pre-bias for the active diodes of the converter 2. This capacitor 30 having a lesser capacitance than the previous capacitor 3 because of the lower power involved. The outputs of the storage capacitors 3, 30 are linked to the input of a regulator, these outputs being isolated by a diode circuit 31 connected for example to the output branch of the first capacitor 3 and of the second capacitor 30. More particularly, the capacitors 3, 30 are linked, via the isolating circuit 31, to the input of a transistor 32 of MOS type whose output delivers the desired regulated voltage, for example equal to 3 volts. In airborne use, the second transducer 10 makes it possible to obtain a voltage as soon as the airplane starts up, since the beams recover the energy right from the first vibrations. The use of the thermal transducer, with Seebeck effect, does not make it possible to obtain a voltage at startup since the voltage delivered builds up slowly during the takeoff phase 201 as shown by FIG. 2*c*.

The layout of the regulator is conventional, of the series type. It therefore comprises the transistor 32 whose gate is controlled by the output of an operational amplifier device 33 which undertakes the regulation. For this purpose, one input of the operational amplifier 33 is linked to the output voltage of the transistor 32 and the other input is linked to a reference voltage 35, corresponding to the desired regulated voltage. The voltage thus obtained makes it possible for example to power one or more sensors 34 and optionally a microprocessor system comprising notably an energy management cell 37. This cell controls for example the voltage reference used by the series regulator by means of the appropriate interfaces.

A circuit 36 provides the bias current for the operational amplifier and the low-breakdown diodes. A circuit according to the invention makes it possible to obtain a bias current of the order of a few nano amperes (nA). By way of example a bias current of 10 nA will be adopted hereinafter.

FIGS. 4*a* to 4*d* present layouts according to the prior art which make it possible to obtain a current I=10 nA.

Figure 4B:
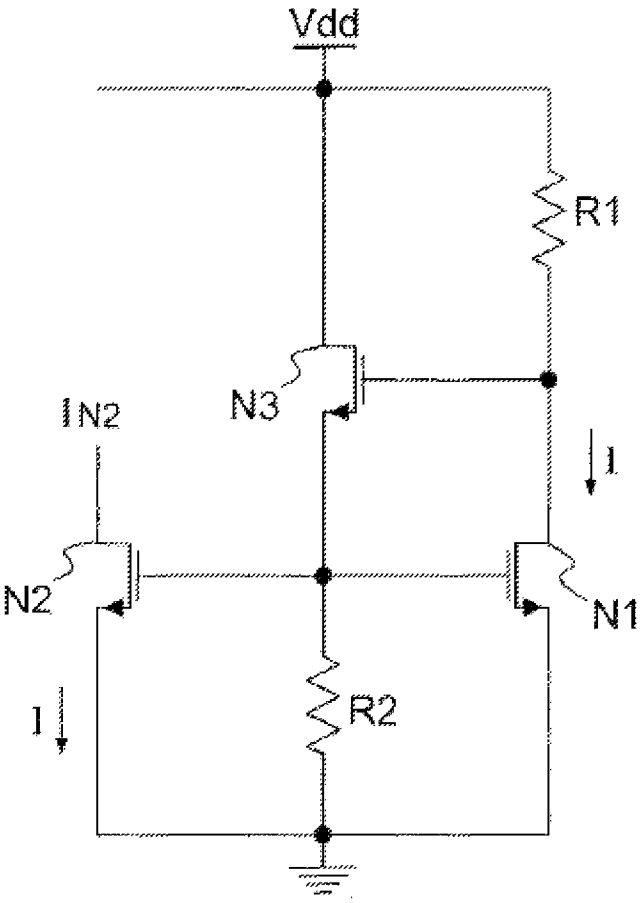
FIGS. 4*a* to 4*d*, examples of generating very low currents according to the prior art.
Figure 4A:
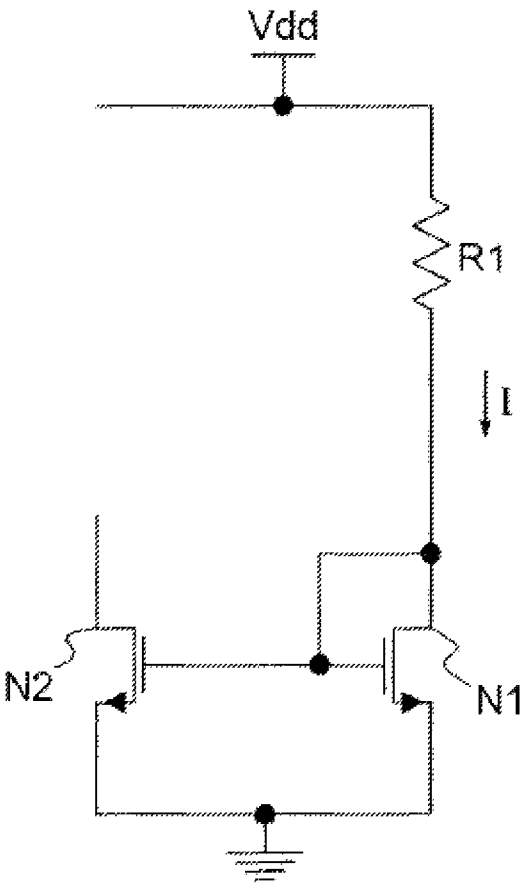

In the first layout illustrated by FIG. 4*a*, a resistor R1 is connected in series between a supply voltage Vdd and a field-effect transistor N1 the drain of which is connected to the gate and the source to the ground potential. Hereinafter, the field-effect transistors will be called MOS transistors according to their conventional terminology. A second MOS transistor N2 is common-gate connected with the transistor N1, according to a layout of the current mirror type. The sources of the two transistors N1, N2 are connected to the ground potential.

The resistor R1 is traversed by a current I, given by the following relation:

$$R1 = \frac{(Vdd - Vgs)}{I} \tag{1}$$

taking a voltage Vdd=3.3 V and a voltage Vgs=0.8 V, Vgs being the voltage between the gate and the source of the transistor N1.

To obtain I=10 nA, a resistor R1 of resistance equal to 250 MOhms is required. Such a resistor cannot be produced in an integrated circuit, the necessary area being much too large. Moreover, the value of the current I depends greatly on the supply voltage Vdd.

The second layout illustrated by FIG. 4*b*, a resistor R2 is connected between the gates of the transistors N1 and N2 and the ground potential, a third MOS transistor N3 being linked between the resistor R2 and the voltage Vdd. The gate of the transistor N3 is linked at a point situated between the resistor R1, still connected to the potential Vdd, and the drain of the transistor N1. In this layout, the resistor R1 is traversed by a current I, given by the following relation:

$$R1 = \frac{(Vdd - 2Vgs)}{I} \tag{2}$$

Still for a current I=10 nA, a resistance R1=170 MOhms and a resistance R2 of greater than 80 MOhms are required. These values are still too large since they still require too large a production area and the value of the current I again depends greatly on the supply voltage Vdd.

Figure 4D:
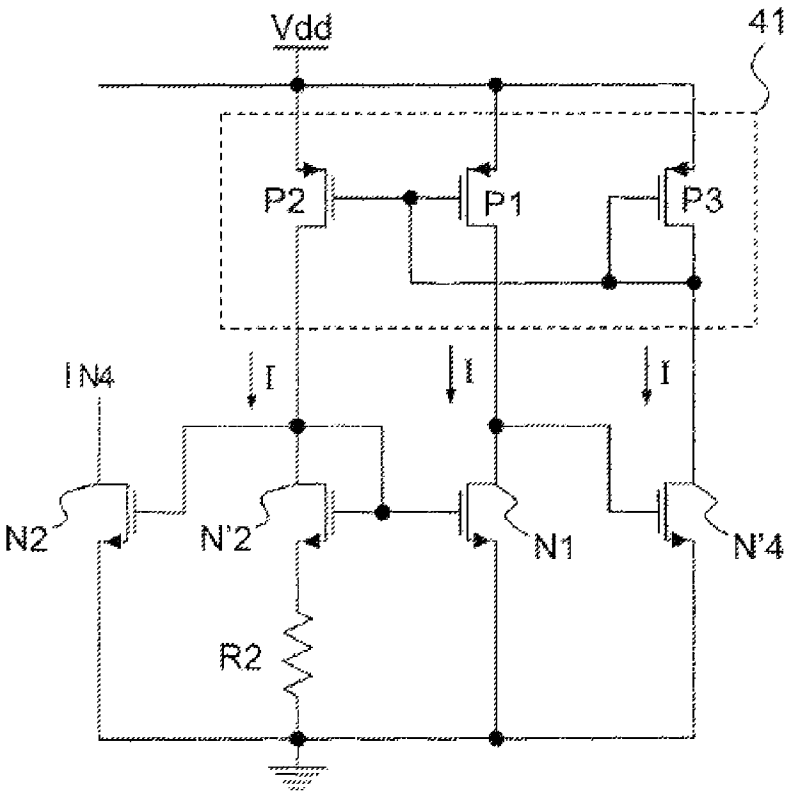
Figure 4C:
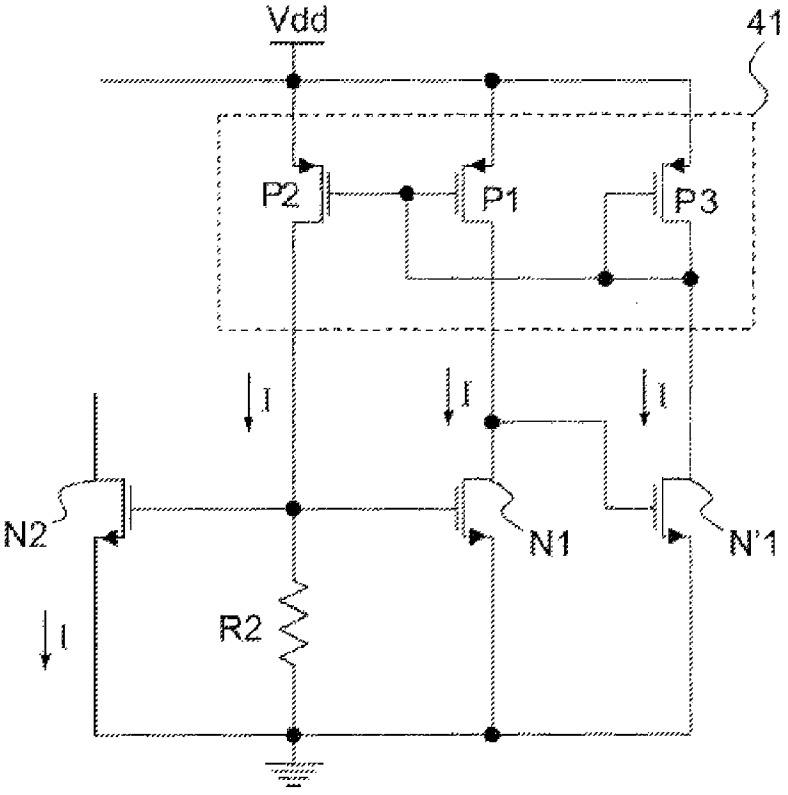

In the layout of FIG. 4*c*, the resistor R1 is replaced with three MOS transistors P1, P2, P3 in parallel of the P-channel type, connected as a current mirror. The other transistors are of the N-channel type as for the other layouts 4*a* and 4*b*. The sources of the three P-channel transistors are connected to the voltage Vdd, their gates being connected to the drain of the third transistor P3, which has its gate linked to its drain. The drain of the first transistor P1 is connected to the drain of the transistor N1, the drain of the second transistor P2 is to the resistor R2 and the drain of the third transistor P3 is connected to the drain of a transistor N'1, the gate of the transistor N'1 being connected to the drain of the transistor N1. The current I traversing the transistors of the current mirror is given by the following relation:

$$I = \frac{Vgs}{R2} \tag{3}$$

To obtain a current I=10 nA, a resistance R2=80 MOhms is required, this still being too large in value. Nonetheless, the value of the current I is relatively independent of the supply voltage Vdd.

In the layout illustrated by FIG. 4*d*, an N-channel transistor N'2 is connected in series with the resistor R2.

For transistors that are rated to operate under weak inversion, it may be demonstrated that the value of the voltage $V_{R2}$ across the terminals of the resistor R2 may be given by the following relation:

$$V_{R2} = U_T \ln\left(\frac{S_{N'2}S_{P1}}{S_{N1}S_{P2}}\right) \tag{4}$$

where $S_{N'2}$, $S_{P1}$, $S_{N1}$, $S_{P2}$ represent respectively the areas of the transistors N'2, P1, N1 and P2, $U_T$ representing the thermal voltage.

By considering this voltage equal to 50 mV, to obtain a current I=10 nA, a resistor R2 having a resistance of about 5 MOhms is then required. The result obtained is therefore better with respect to the other results, but this value is still too high to be built into integrated circuits.

Figure 5:
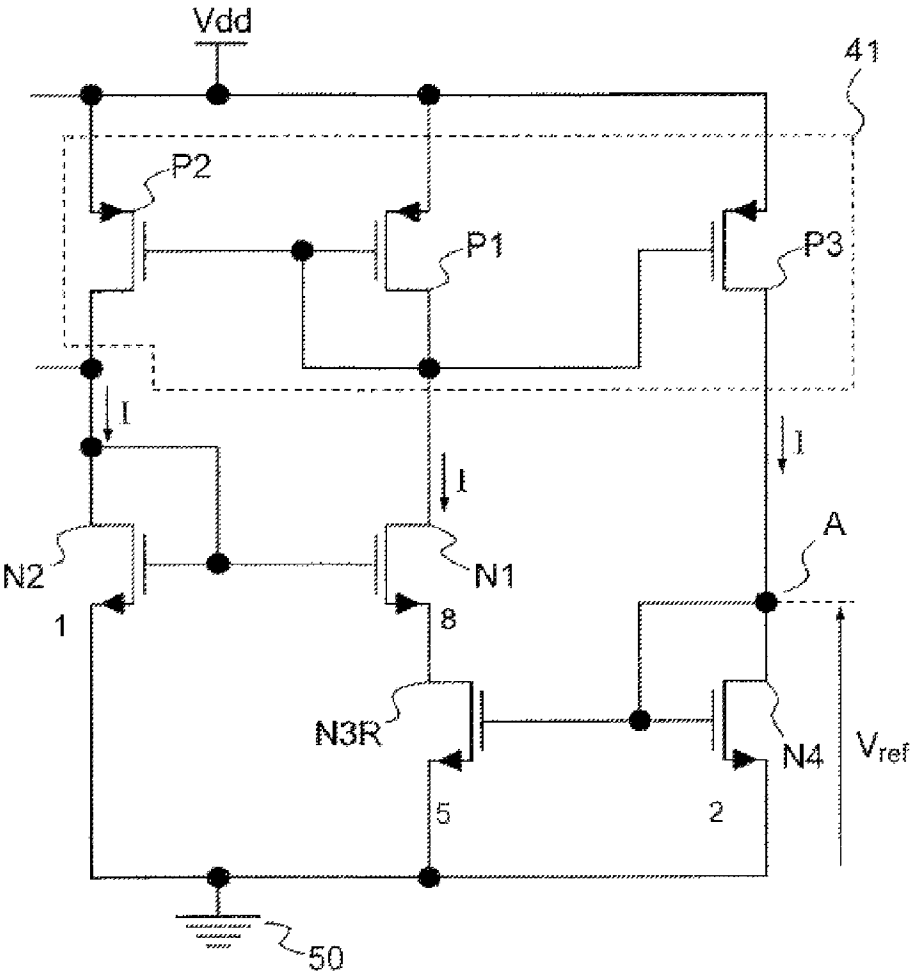
FIG. 5, an exemplary circuit for generating current used in the invention.

FIG. 5 presents the basic diagram of an exemplary circuit used by the invention not using any resistor, this circuit being able notably to be used as bias circuit 35, 36 in the energy recovery chain illustrated by FIG. 3. The layout comprises for example a current mirror 41, with the same transistors as those of FIGS. 4*c* and 4*d*. In this layout, it is the transistor P1 which has its gate linked to its drain. The drain of the first transistor P1 is linked to the drain of an N-channel transistor N1. The drain of the second transistor P2 is linked to the drain of an N-channel transistor N2 common gated with the transistor N1, the drain and the gate of the transistor N2 being linked. The drain of the third transistor P3 is linked to the drain of an N-channel transistor N4.

The source of the transistor N1, linked moreover to the first transistor P1 of the current mirror, is linked to the drain of a transistor N3R whose gate is linked to the gate of the transistor N4 linked moreover to the third transistor P3. The gate and the drain of the transistor N4 are linked, the transistors N3R and N4 being wired as a current mirror.

The sources of the transistors N2, N3R, N4 are linked to the ground potential 50. The transistor N3R operates as a resistor.

The transistors N1 and N2 are biased to operate in a zone of weak inversion and behave as bipolar transistors. The transistor N3R is biased to operate in a zone of strong inversion and to thus operate in the linear zone, with a very weak drain voltage. In accordance with relation (4), the voltage $V_{SN1}$ across the terminals of the transistor N3R is given by the following relation:

$$V_{N3R} = U_T \ln\left(\frac{S_{N2}S_{P1}}{S_{N1}S_{P2}}\right) \quad (5)$$

where $S_{N2}$, $S_{P1}$, $S_{N1}$, $S_{p2}$ represent respectively the areas of the transistors N2, P1, N1 and P2, $U_T$ representing the thermal voltage.

A regulator of conventional "band gap" type is thus obtained, with the MOS transistor N3R operating as resistor, this regulator providing a voltage that is constant with temperature and independent of the supply voltage, this voltage acting as reference voltage $V_{Ref}$ at output. This voltage is available at a point A at the level of the drain of the transistor N4 linked to the gate of the latter and to the gate of the transistor N3R.

The current I traversing the transistor N3R and also the other branches of the current mirror is equal to $$\frac{V_{N3R}}{R_{eq}}$$

where $R_{eq}$ is the equivalent resistant of the transistor N3R:

$$I = \frac{U_T}{R_{eq}} \ln\left(\frac{S_{N2}S_{P1}}{S_{N1}S_{P2}}\right) \quad (6)$$

The diagram of FIG. 5 shows that a circuit of the PTAT (which stands for "Proportional To Absolute Temperature") type is obtained since according to relation (6), the current is directly proportional to the absolute temperature:

$$I = \alpha \cdot T \quad (7)$$

Indeed, in relation (6), all the parameters are constant except the thermal voltage which depends directly on the absolute temperature.

Figure 6:
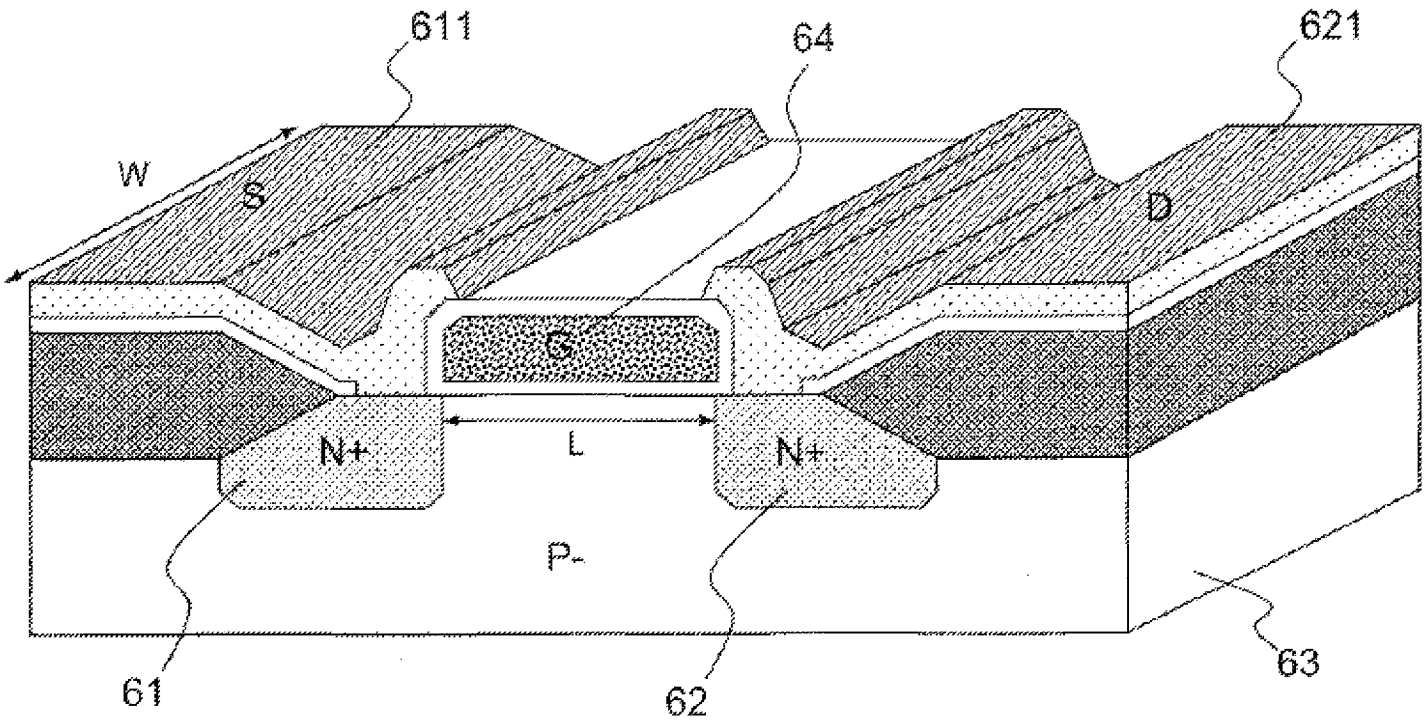
FIG. 6, a reminder of the structure of a field-effect transistor.

FIG. 6 recalls through a sectional view the conventional structure of a MOS transistor, in this example of N-channel type, in so-called "bulk" technology. The doped zones 61, 62 forming the source and the drain are implanted directly in a silicon mass 63 forming a substrate. Metallic interfaces 611, 621 in contact with the doped zones 61, 62 allow electrical connections with the outside. The gate 64 disposed along the channel situated between the doped zones 61, 62 is insulated by a layer of silicon oxide ($SiO_2$).

The length L of the channel is the distance between the two diffusion zones 61, 62 forming the source and the drain. The width W of the channel is the perpendicular dimension in the plane of the substrate. In a conventional structure of a MOS transistor, the length is small and the ratio L/W is small, typically less than 1 as illustrated by FIG. 6. According to the invention, to obtain the desired equivalent resistance $R_{eq}$, the transistor N3R of the layout of FIG. 5 has a channel of very large length with respect to the width, the ratio L/W being not only greater but very high, of the order of several hundred for example, greater than 500 for example. The same holds for the transistor N4. The diagram of FIG. 5 therefore presents a regulator of "PTAT and band gap" type according to a conventional structure but according to the invention, the resistance is produced by a MOS transistor operating in its linear zone, this transistor having an ultra-long channel. The trials performed by the Applicant have shown that this transistor structure, with very narrow channel, possibly down to 0.6 μm and ultra-long, makes it possible to obtain a quasi-constant current value as a function of the variation in supply voltage Vdd. Stated otherwise, the ratio ΔI/ΔVdd is very small, ΔI being the variation in current generated and ΔVdd the variation in the supply voltage. In practice, this ratio may be of the order of 1 to 2%. This result is very noteworthy and very significant for the making of generators of very low currents, associated with a quasi-constant variation of this same current as a function of temperature.

Thus, this structure with ultra-long channel makes it possible to obtain, in the transistors N3R and N4, a current that is quasi-stable with temperature and very low, quasi-stable as a function of the variations of the supply voltage, and also a temperature-stable low gate-source voltage. In the layout of FIG. 5, this voltage is equal to the voltage $V_{ref}$ across the drain-source terminals of the transistor N4. This reference voltage may be advantageously used as voltage step for carrying out voltage regulation as will be shown by the subsequent description.

The structure of such a transistor, with ultra-long channel, is illustrated by the following figures.

Figure 7:
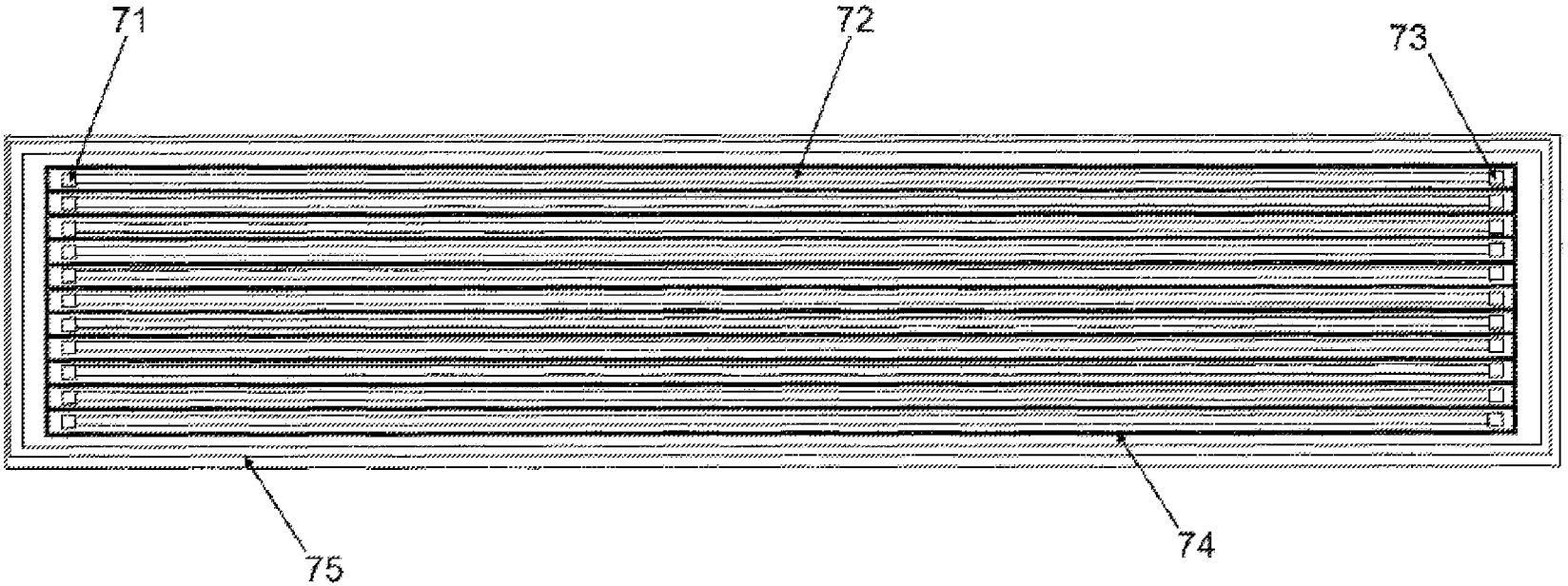
FIG. 7, a topographic presentation of field-effect transistors, with ultra-long channels used in a device according to the invention.

FIG. 7 illustrates an embodiment of MOS transistors used in a device according to the invention. FIG. 7 presents, through a topographic view, an integrated circuit structure with several MOS transistors, N-channel in this example, these MOS transistors having an ultra-long channel. The source 71, the channel 72 and the drain 73 are represented for each transistor. The figure shows that the channels of the transistors are ultra-long. Each transistor is integrated into an $N^+$-doped well 74 implanted on a $P^-$-doped substrate 75 in accordance with a structure of bulk type for example.

Figures 8A, 8B:
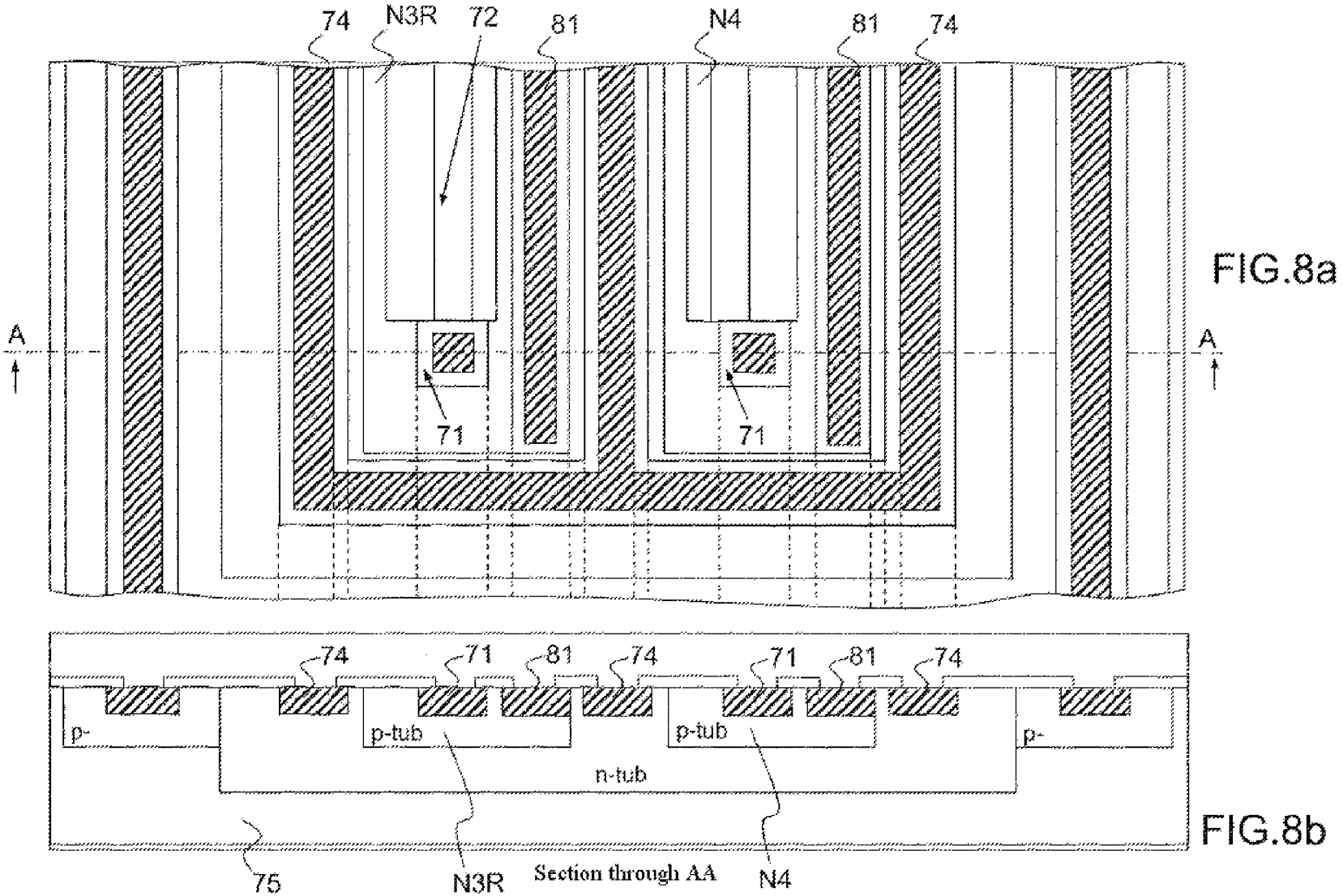
FIGS. 8*a* and 8*b*, through a topographic view and through a sectional view a more detailed presentation of an embodiment of field-effect transistors, with ultra-long channels, used in a generator according to the invention.

FIGS. 8*a* and 8*b* more precisely illustrate one of the MOS transistors of the view of FIG. 7, FIG. 8*a* presenting a view from above and FIG. 8*b* presenting a sectional view through AA for a structure of bulk type, other types of structures being possible. FIG. 8*a* shows an end of two MOS transistors with the sources 71 represented, the channel 72 extending in the direction D toward the drains, the latter not being represented. The transistors are diffused and insulated in a well 74, a $P^+$-doped wall 81 ensures insulation between the transistors.

These FIGS. 8*a* and 8*b* illustrate for example the production of the transistors N3R and N4 of the layout of FIG. 5, implanted for example with other transistors of the same structure or of different structure on the same ground substrate 75.

Figure 9:
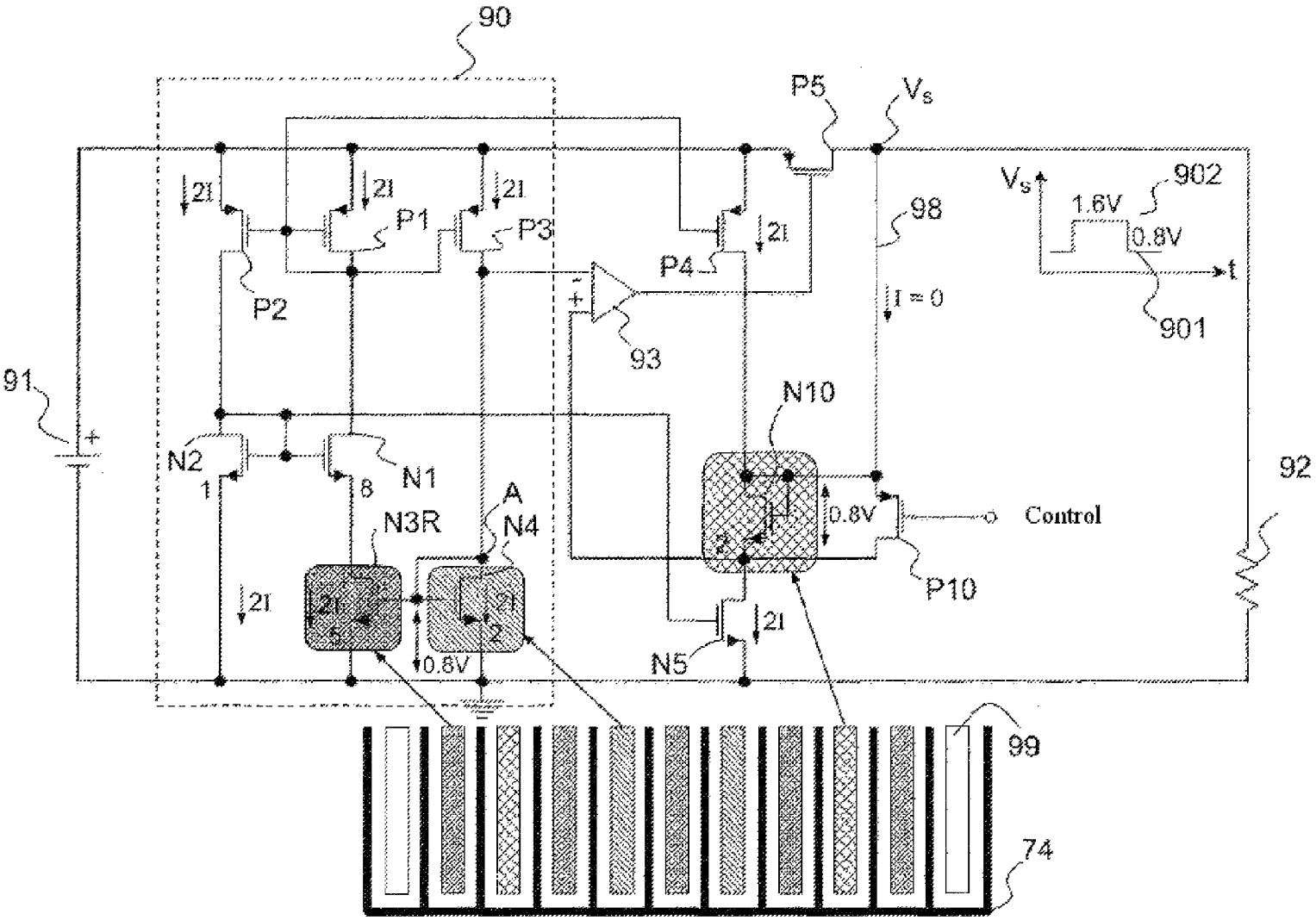
FIG. 9, an exemplary embodiment of a regulator according to the invention.

FIG. 9 presents an exemplary embodiment of a regulator according to the invention using a layout of the type of that of FIG. 5 with ultra-long MOS transistors N3R and N4 embodied for example according to FIGS. 8*a* and 8*b*. In the example of FIG. 9, the circuit performs regulation with two voltage levels 901, 902. The voltage step is for example 0.8 V, thus 0.8 V or 1.6 V is obtained.

The circuit employs a part 90 corresponding to the diagram of FIG. 5. This part 90 is linked at input to a capacitor 91 corresponding for example to an energy storage device 3. At the output of the capacitor the voltage regulation is afforded by a P-channel MOS transistor, referenced P5, the regulated voltage being delivered as output loaded for example by a resistor 92. The source of this transistor P5 is linked to the capacitor 91 and to the sources of the transistors P1, P2, P3 of the current mirror. The point A, at the level of the drain of the transistor N4, is linked to the negative input of an operational amplifier 93 whose output is linked to the gate of the output transistor P5. As described in relation to FIG. 5, the point A exhibits the reference voltage. In the example of FIG. 9, this voltage is equal to 0.8 V. This reference voltage is therefore present at the negative input of the operational amplifier 93.

A fourth transistor P4, of P-channel type, is connected as a current mirror with the transistors P1, P2, P3. A third transistor N5, of N-channel type, is connected as a current mirror with the transistors N1, N2. A pair of MOS transistors N10, P10 is connected between the drain of the transistor P4 and the drain of the transistor N5. More particularly, the drain of the transistor N10 is connected to the drain of the transistor P4 and its source is connected to the drain of the transistor N5.

The transistor P10 is connected to the transistor N10, its source and its drain being respectively connected to the drain and to the source of the transistor N10. The gate and the drain of the transistor N10 are together linked to the source of the transistor P10 itself linked to the drain of the transistor P5 providing the regulated output voltage Vs. The source of the transistor N10 and the drain of the transistor P10 being together linked to the positive input of the operational amplifier.

By mirror effect, the two transistors P4 and N5 convey the same current 21. Given that the transistor N10 is connected between these two transistors, it conveys this same current 21 between its drain and its source in its branch which links it to the transistor N5. The current on the other branches is then zero.

These other branches, notably the branch 98 linking the transistor N10 to the transistor P5, then advantageously exhibit a high equivalent impedance. It follows from this that the potential $V_{ref}$, for example 0.8 volts, across the terminals of the transistor N4 is transferred to the terminals of the transistor N10, when the latter is conducting.

The conduction of the transistor P10 is controlled by a control signal applied to its gate and short-circuits the transistor N10 by providing the voltage steps. In the case of an application of the type of FIG. 3, this signal is for example provided by the energy management cell 37 either by software 37, or by a hardware circuit by direct connection of the controls to the voltage Vdd or to the electrical ground.

When the transistor N10 is switched to the off state, the output voltage is equal to 0.8 V which is the voltage across the terminals of the transistor N4. When the transistor N10 is switched to the on state, the voltage of 0.8 V present across the terminals of the transistor N10 is added, as described previously, and makes it possible to obtain a voltage of 1.6 V as output Vs.

Like the transistors N3R and N4, the transistor N10 is a MOS transistor with ultra-long channel. The transistor N10 is identical to the transistors N3R and N4 so as to ensure perfect stability with temperature.

FIG. 9 illustrates through a schematic view ("lay-out") situated facing the transistors of the electrical diagram a possible embodiment, more particularly a mode of arrangement of the transistors inside the well. The transistors are represented by their long channels inside the well 74. Advantageously, the transistors N3R, N4 and N10 are inter-digitated so as to be twinned to the best possible extent, and to thus exhibit the closest possible electrical characteristics.

Phantom (also called "dummy") transistors 99 are for example inserted inside the well. These dummy transistors have their terminals short-circuited.

The transistors N10 and P10 may be combined into a single transistor.

Figure 10:
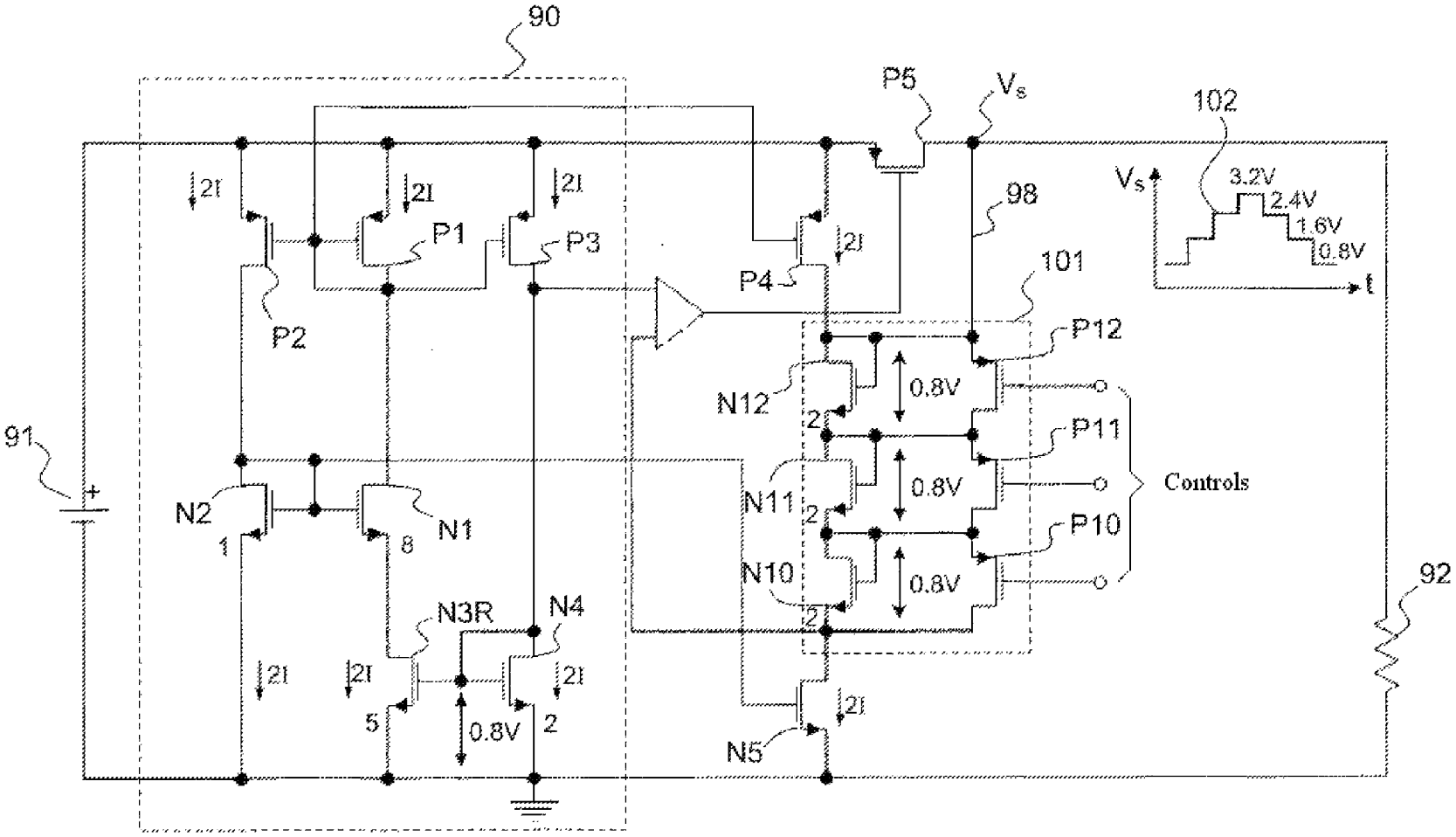
FIG. 10, another exemplary embodiment of a regulator according to the invention.

FIG. 10 presents an exemplary embodiment of a regulator according to the invention having four voltage levels 102 with four steps of 0.8 V, another reference voltage being of course possible. For this purpose the pair of transistors N10, P10 of FIG. 9 is replaced with a layout 101 with three pairs of transistors (N10, P10), (N11, P11), (N12, P12) in series. The layout 101 is still connected between the transistors P4 and N5. The pairs of transistors are connected together in the same manner as the pair (N10, P10) in the layout of FIG. 9. Each pair is controlled by a control signal. As in the case of the layout of FIG. 9, depending on whether it is on or off, one of the three transistors N10, N11, N12 does or does not exhibit a voltage of 0.8 V across its terminals, thus adding, or not, a voltage step of 0.8 V at output Vs.

The example of FIG. 10 presents three pairs of transistors in series between the transistor P4 and the transistor N5. It is of course possible to envision a different number K thereof.

By way of example, the dimensions of a transistor with ultra-long channel may be 0.6 μm for the width W and 320 μm for the length L. The ratio L/W of an ultra-long channel is at least of the order of a few tens and may reach several hundred, or indeed reach the value 1000 and beyond.

Figure 11:
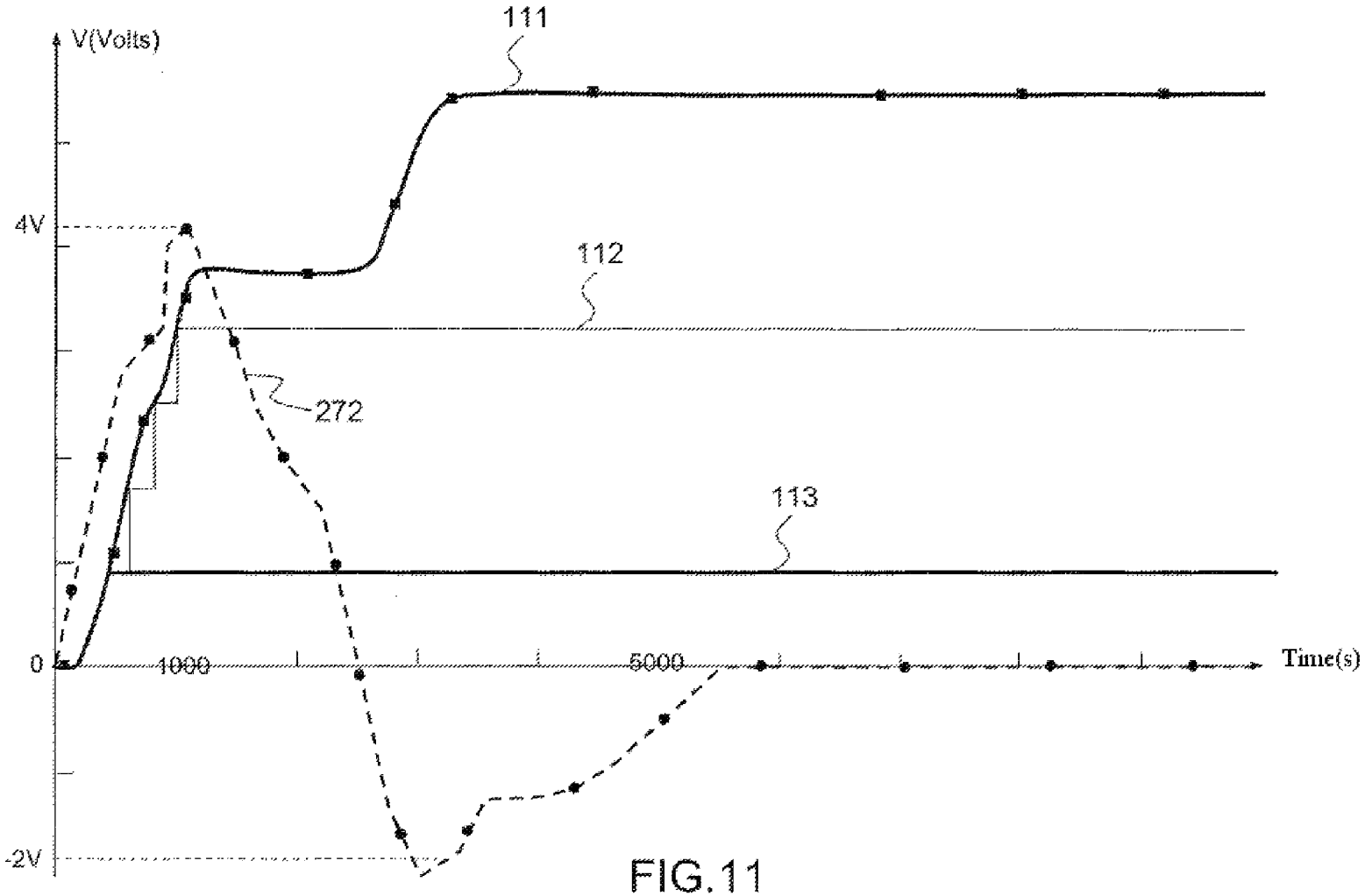
FIG. 11, a presentation of the voltage curves for an application with a Seebeck-effect thermal transducer as autonomous energy source.

FIG. 11 illustrates a case of use of a regulator according to FIG. 10 in the case where the energy source is a Seebeck-effect thermal transducer 1.

A first curve 272 illustrates the profile of the voltage produced by the transducer throughout an airplane's flight phases, takeoff, cruising flight and landing, as defined in relation to FIG. 2*c*. The curve 111 represents the voltage recovered after the DC/DC voltage conversion. The curve 112 represents the regulated voltage at the output of the transistor P5 when using the tracking based on voltage steps under software control. The curve 113 represents the voltage at output when using a single voltage step under hardware control.

The invention has been described within the framework of an avionics application. It can be applied in many other sectors. For example, it can notably be applied advantageously in devices of the space sector.

I claim:

1. A current generator using field-effect transistors, the current generator comprising:

a first plurality of Q transistors connected as a current mirror and linked to a supply voltage, each of the first plurality of transistors having a channel of a first polarity;

a second plurality of Q-1 transistors connected as a current mirror, each having a channel of a second polarity that is the reverse of the first polarity, and each connected in series to a transistor included in the first plurality of transistors;

a first transistor N3R having a channel of the second polarity and a gate, having an equivalent resistance $R_{eq}$, and connected in series with a transistor included in the second plurality of transistors; and a second transistor N4 having a gate and a drain, connected as a current mirror with the first transistor N3R, and connected in series with a transistor included in the first plurality of transistors, the gate and the drain of the transistor N4 are linked; wherein the first transistor N3R operates in its linear zone, an amount of current generated by the current generator depends on the equivalent resistance $R_{eq}$ of the first transistor N3R, and the first and second transistors N3R, N4 each have an ultra-long channel, each ultra-long channel having a ratio L/W greater than several hundred, L being the length of the ultra-long channel and W its width, the values of W and of L/W being determined to obtain a stable value of current as a function of a variation of the supply voltage.

2. The current generator according to claim 1, wherein each ratio L/W is greater than 500.

3. The generator according to claim 1, wherein each width W is of the order of 0.6 μm.

4. The current generator as claimed in claim 1, the current generator is used as voltage reference, with a reference voltage $V_{ref}$ provided at the level of gates of the first and second transistors N3R, N4.

5. The current generator according to claim 1, wherein the first plurality of transistors are each of P-channel type.

6. A voltage regulator, for regulating between an input voltage and an output voltage, using field-effect transistors, said voltage regulator comprising:

the current generator according to claim 4;

a first P-channel type field-effect output transistor P5 linked at its source to the input voltage and delivering on its drain the output voltage;

an operational amplifier with a negative input linked to the reference voltage $V_{ref}$;

a second P-channel type transistor P4, connected as a current mirror with the first plurality of transistors;

a first N-channel type transistor N5, connected as a current mirror with the second plurality of transistors; and a first pair of transistors including a second N-channel type transistor N10 and a third P-channel type transistor P10, connected between the second P-channel transistor P4 and the first N-channel transistor N5; wherein a gate and a drain of the second N-channel type transistor N10 are linked to a source of the third P-channel type transistor P10 linked to a drain of the second P-channel type transistor P4 and to a drain of the first P-channel type field-effect output transistor P5;

a source of the second N-channel type transistor N10 and the drain of the third P-channel type transistor P10 are linked to a positive input of the operational amplifier and to a drain of the first N-channel type transistor N5;

a channel of the second N-channel type transistor N10 is very long, so that the ratio L/W is very large, L being the length of the channel and W its width;

the reference voltage $V_{ref}$ is present across terminals of the second transistor N4 is reproduced across terminals of the second N-channel type transistor N10 when the second N-channel type transistor N10 is switched to an on state; and the output voltage is incremented according to the reference voltage $V_{ref}$ dependent on control of the second N-channel type transistor N10.

7. The regulator according to claim 6, further comprising a second pair of transistors including a third N-channel type transistor N11 and a fourth P-channel type transistor P11 connected in series between the second P-channel type transistor P4 and the first N-channel transistor N5;

a third pair of transistors including a fourth N-channel type transistor N12 and a fifth P-channel type transistor P12 connected in series between the second P-channel type transistor P4 and the first N-channel transistor N5; and means of control of the first, second, and third pairs of transistors; wherein the third N-channel type transistor N11 and the fourth N-channel type transistor N12 each exhibit reference voltage Vref when switched into an on state; and the output voltage is dependent on a given number of voltage steps of the reference voltage Vref according to a combination of control states applied to the first, second, and third pairs of transistors.

8. The regulator according to claim 7, wherein the first, second, and third N-channel type transistors N10, N11, N12 are inserted into a block of transistors including the first and second transistors N3R, N4 with ultra-long channels.

9. The regulator according to claim 8, wherein the first, second, and third N-channel type transistors N10, N11, N12 are disposed in a symmetric manner with respect to the second transistor N4, the first, second, and third N-channel type transistors N10, N11, N12 having the same structure as the second transistor N4.

* * * * *